US007821192B2

(12) United States Patent
Feng et al.

(10) Patent No.: US 7,821,192 B2
(45) Date of Patent: Oct. 26, 2010

(54) FIELD EMISSION LIGHT SOURCE

(75) Inventors: Chen Feng, Beijing (CN); Peng Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 356 days.

(21) Appl. No.: 11/967,113

(22) Filed: Dec. 29, 2007

(65) Prior Publication Data

US 2009/0072706 A1 Mar. 19, 2009

(30) Foreign Application Priority Data

Sep. 14, 2007 (CN) ..... 200710077111

(51) Int. Cl.
*H01J 17/49* (2006.01)

(52) U.S. Cl. ..... 313/496; 313/495

(58) Field of Classification Search ..... 313/495–497
See application file for complete search history.

(56) References Cited

U.S. PATENT DOCUMENTS 7,630,040 B2 * 12/2009 Liu et al. ..... 349/123

* cited by examiner

*Primary Examiner*—Nimeshkumar D Patel
*Assistant Examiner*—Anne M Hines
(74) *Attorney, Agent, or Firm*—Jeffrey T. Knapp

(57) ABSTRACT

A field emission light source includes a substrate, a cathode conductive layer, a plurality of electron emitters, a transparent substrate, an anode layer and a fluorescent layer. The cathode conductive layer is formed on the substrate. The electron emitters are disposed on the cathode conductive layer. The transparent substrate is spaced from the cathode conductive layer. The anode layer is formed on the transparent substrate facing the electron emitters and includes a carbon nanotube film structure having carbon nanotubes arranged in a preferred orientation. The fluorescent layer is formed on the anode layer facing the electron emitters.

14 Claims, 4 Drawing Sheets

FIELD EMISSION LIGHT SOURCE

BACKGROUND

1. Field of the Invention

The invention relates to field emission light sources and, particularly, to a field emission light source with polarized light emission.

2. Discussion of Related Art

A light source using the field emission effect is generally named a field emission light source. Presently, the field emission light source includes a substrate, a cathode conductive layer formed on the substrate, a plurality of electron emitters disposed on the cathode conductive layer, a transparent substrate disposed separately from the cathode conductive layer, an anode layer formed on the transparent substrate facing the electron emitters and a fluorescent layer formed on the anode layer. The anode layer is generally made of indium tin oxide. However, the field emission light source cannot emit polarized light.

In the optical field, a polarizer is used to absorb or reflect light in some direction to acquire polarized light. Though the polarizer can polarize light, the polarizer itself is not a light source. In actual application, the polarizer must be combined with an extra light source to realize the emission of polarized light.

What is needed, therefore, is a field emission light source that can directly emit polarized light.

SUMMARY

In one embodiment, a field emission light source includes a substrate, a cathode conductive layer, a plurality of electron emitters, a transparent substrate, an anode layer, and a fluorescent layer. The cathode conductive layer is formed on the substrate. The electron emitters are disposed on the cathode conductive layer. The transparent substrate is spaced from the cathode conductive layer. The anode layer is formed on the transparent substrate facing the electron emitters and includes a carbon nanotube film structure having carbon nanotubes arranged in a preferred orientation. The fluorescent layer is formed on the anode layer facing the electron emitters.

Other advantages and novel features of the field emission light source will become more apparent from the following detailed description of preferred embodiments, when taken in conjunction with the accompanying drawings.

BRIEF DESCRIPTION OF THE DRAWINGS

Many aspects of the field emission light source can be better understood with reference to the following drawings. The components in the drawings are not necessarily to scale, the emphasis instead being placed upon clearly illustrating the principles of the field emission light source.

Figure 1:
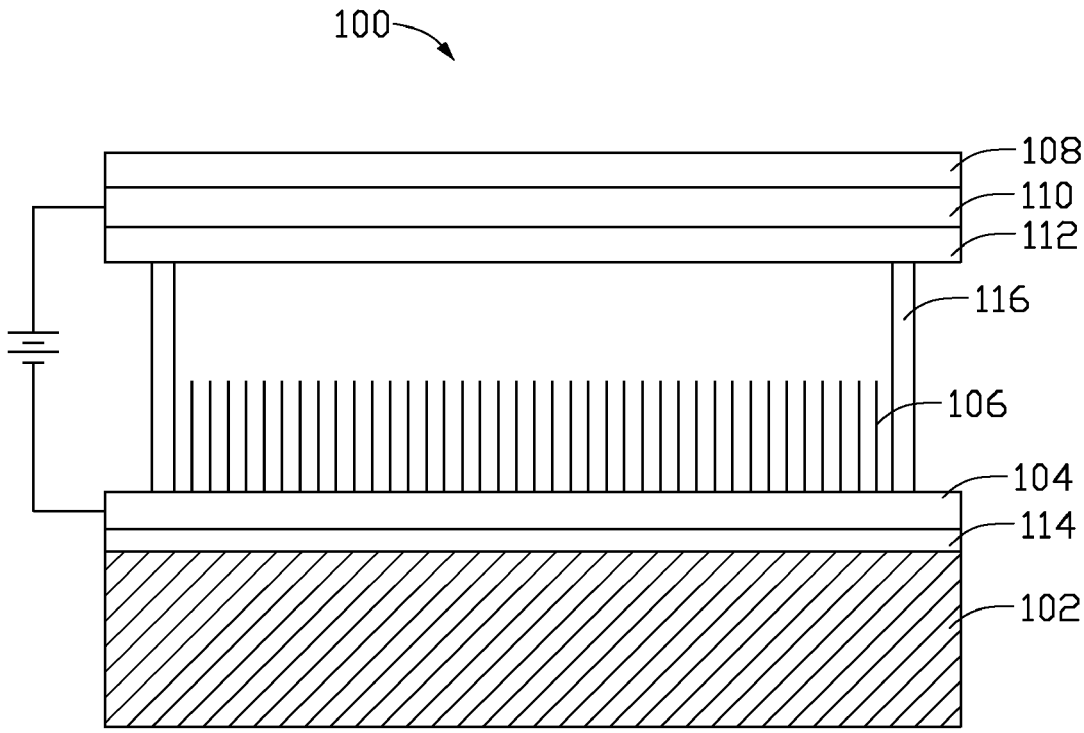
FIG. 1 shows a structural schematic view of a field emission light source, in accordance with the present embodiment.

Corresponding reference characters indicate corresponding parts throughout the several views. The exemplifications set out herein illustrate at least one preferred embodiment of the field emission light source, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the field emission light source.

Referring to FIG. 1, a field emission light source 100 includes a substrate 102, a cathode conductive layer 104 formed on the substrate, a plurality of electron emitters 106 disposed on the cathode conductive layer 104, a transparent substrate 108 spaced apart from the cathode conductive layer 104, an anode layer 110 formed on the transparent substrate 108 facing the electron emitters 106, and a fluorescent layer 112 formed on the anode layer facing the electron emitters 106.

The substrate 102 has a planer surface. The substrate 102 is a non-metal substrate. The material of the substrate can be selected from silicon, silicon dioxide, glass, and so on.

The cathode conductive layer 104 can be deposited on the substrate 102. The material of the cathode conductive layer 104 can be selected from a group consisting of copper, silver, and gold. A deposition layer 114 can further be formed between the substrate 102 and the cathode conductive layer 104. The material of the deposition layer 114 is made of silicon. The thickness of the deposition layer 114 is small. Beneficially, the thickness of the deposition layer 114 is less than 1 micrometer. Since the substrate 102 is a non-metal substrate, the formation of the deposition layer 114 is conducive to the formation of the cathode conductive layer 104. It can be understood that the deposition layer 114 is a selective layer. Whether the deposition layer 114 is formed or not depends on actual application.

The electron emitters 106 have micro-tips, which may for example be tungsten micro-tips, zinc oxide micro-tips, or diamond micro-tips. In general, a material of the electron emitters 106 is generally selected from a group consisting of metals, non-metals, compositions, and one-dimensional nanomaterials. The compositions include zinc oxide and other substances known in the art. The one-dimensional nanomaterials may include nanotubes, nanowires, or the like, such as carbon nanotubes, silicon nanowires, or molybdenum nanowires. The transparent substrate 108 can be transparent glass substrate.

Figure 2:
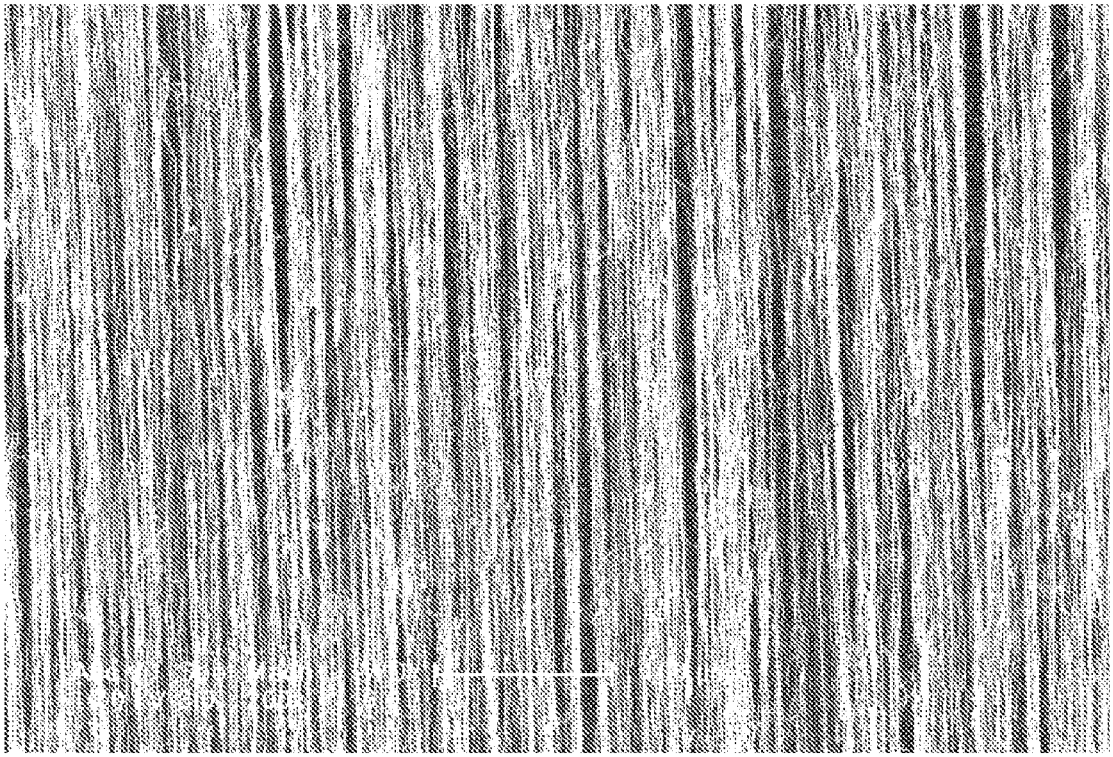
FIG. 2 shows a Scanning Electron Microscope (SEM) image of a carbon nanotube film.

The anode layer 110 includes a carbon nanotube film structure. The carbon nanotube film structure includes at least one layer of carbon nanotube film. A Scanning Electron Microscope (SEM) image of the carbon nanotube film can be seen in FIG. 2. The carbon nanotubes in the carbon nanotube film structure are arranged in a preferred orientation. Because the carbon nanotubes have uniform absorption ability anywhere in the electromagnetic spectrum, the carbon nanotube film structure also has a uniform polarization property throughout the electromagnetic spectrum. When light is transmitted into a front side of the carbon nanotube film structure, the light parallel to the carbon nanotubes is absorbed by the carbon nanotubes, and the light normal to the carbon nanotubes is transmitted through the carbon nanotube film structure. Accordingly, polarized light is transmitted through the anode layer 110. The method for making the carbon nanotube film includes the steps of: (a) providing an array of carbon nanotubes, quite suitably, providing a super-aligned array of carbon nanotubes; (b) selecting a plurality of carbon nanotube segments having a predetermined width from the array of carbon nanotubes; (c) pulling the carbon nanotube segments at an even/uniform speed to form the carbon nanotube film.

In step (a), the super-aligned array of carbon nanotubes can be formed by the substeps of: (a1) providing a substantially flat and smooth substrate; (a2) forming a catalyst layer on the substrate; (a3) annealing the substrate with the catalyst at the approximate range of 700° C. to 900° C. in air for about 30 to 90 minutes; (a4) heating the substrate with the catalyst up to 500° C. to 740° C. in a furnace with a protective gas therein; and (a5) supplying a carbon source gas into the furnace for about 5 to 30 minutes and growing a super-aligned array of carbon nanotubes from the substrate.

In step (a1), the substrate can, beneficially, be a P-type silicon wafer, an N-type silicon wafer, or a silicon wafer with a film of silicon dioxide thereon. Preferably, a 4-inch P-type silicon wafer is used as the substrate. In step (a2), the catalyst can, advantageously, be made of iron (Fe), cobalt (Co), nickel (Ni), or any alloy thereof. In step (a4), the protective gas can, beneficially, be made up of at least one of nitrogen ($N_2$), ammonia ($NH_3$), and a noble gas. In step (a5), the carbon source gas can be a hydrocarbon gas, such as ethylene ($C_2H_4$), methane ($CH_4$), acetylene ($C_2H_2$), ethane ($C_2H_6$), or any combination thereof.

In step (a), the super-aligned array of carbon nanotubes can, opportunely, be in a height of about 200 to 400 microns and includes a plurality of carbon nanotubes paralleled to each other and approximately perpendicular to the substrate. The super-aligned array of carbon nanotubes formed under the above conditions is essentially free of impurities, such as carbonaceous or residual catalyst particles. The carbon nanotubes in the super-aligned array are packed together closely by van der Waals attractive force.

In step (b), quite usefully, the carbon nanotube segments having a predetermined width can be selected by using a tool (e.g., adhesive tape or another tool allowing multiple carbon nanotubes to be gripped and pulled simultaneously). In step (c), the pulling direction is substantially perpendicular to the growing direction of the super-aligned array of carbon nanotubes.

More specifically, during the pulling step, as the initial carbon nanotube segments are drawn out, other carbon nanotube segments are also drawn out end to end, due to the van der Waals attractive force between ends of the adjacent segments. This process of drawing ensures a successive carbon nanotube film can be formed. The carbon nanotubes of the carbon nanotube film are all substantially parallel to the pulling direction, and the carbon nanotube film produced in such manner is able to be formed having a predetermined width.

The width of the carbon nanotube film depends on the size of the carbon nanotube array. The length of the carbon nanotube film is arbitrarily. In one useful embodiment, when the size of the substrate is 4 inches, the width of the carbon nanotube film is in an approximate range of 1 centimeter to 10 centimeters, and the thickness of the carbon nanotube film is in an approximate range of 0.01 to 100 microns.

It is noted that because the carbon nanotubes in the super-aligned array in step (a) have a high purity and a high specific surface area, the carbon nanotube film is adhesive. As such, the carbon nanotube film can be adhered directly to the surface of the transparent substrate 108.

Figure 4:
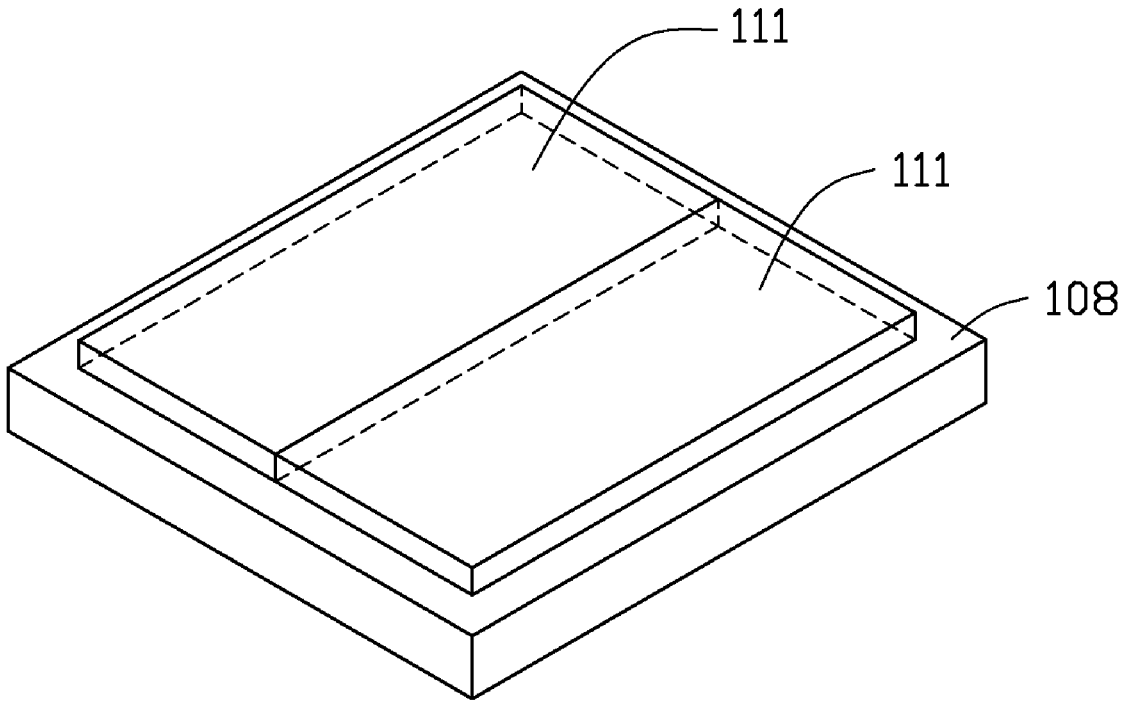
FIG. 4 shows the carbon nanotube film structure comprises a plurality of the carbon nanotube films arranged side by side in parallel to each other.

It will be apparent to those having ordinary skill in the field of the present invention that the size of the transparent substrate 108 can be determined by actual needs/use. When the width of the transparent substrate 108 is greater than that of the carbon nanotube film, a plurality of the carbon nanotube films are adhered to the transparent substrate 108 side by side in parallel to each other. FIG. 4 shows two carbon nanotube films 111 that are adhered to the transparent substrate 108 side by side in parallel to each other.

It is to be understood that, a plurality of carbon nanotube films can adhered to the transparent substrate 108 along a same direction and overlapped with each other to form a carbon nanotube film structure. The number of the layers is determined by actual needs/use. Adjacent layers of carbon nanotube film are combined (i.e., attached to one another) by van de Waals attractive force to form a stable multi-layer carbon nanotube film.

Figure 3:
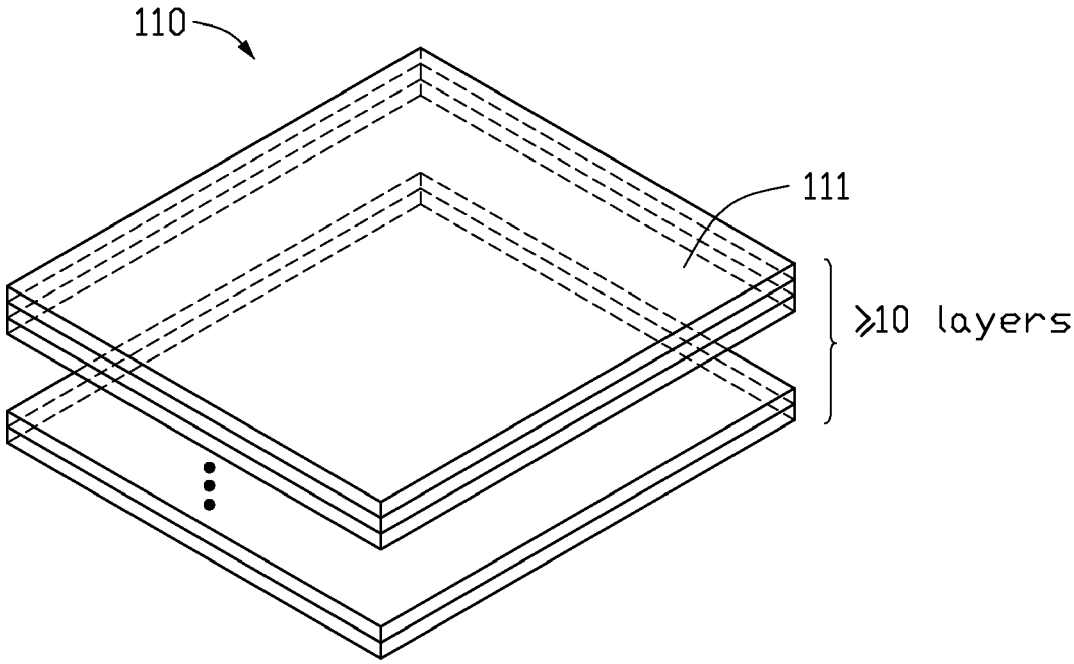
FIG. 3 shows the carbon nanotube film structure comprises more than 10 layers of the carbon nanotube film.

The polarization degree of the carbon nanotube film structure of the anode layer 110 is related to the layers of the carbon nanotube films. The polarization degree increases with the number of the layers of the carbon nanotube film in the anode layer 110. The anode layer 110 employing fewer layers of the carbon nanotube film can only achieve good polarization properties at ultraviolet wavelengths. When the number of layers is increased, the anode layer 110 can achieve good uniform polarization properties over the entire electromagnetic spectrum. In the present embodiment, the anode layer 110 includes at least one layer of carbon nanotube film. Beneficially, there are more than 10 layers of the carbon nanotube film 111, as can be seen in FIG. 3. The thickness of the carbon nanotube film 111 is in an approximate range from 10 nanometers to 100 micrometers. The polarization degree of the anode layer 110 is in an approximate range from 0.85 to 0.9.

The fluorescent layer 112 faces the electron emitters 106. The fluorescent layer 112 includes fluorescent materials selected from a group consisting of red fluorescent materials, green fluorescent materials, and yellow fluorescent materials. Alternatively, the fluorescent layer 112 includes white fluorescent materials. The fluorescent materials are applied to the whole surface of the anode layer 110 facing the electron emitters 106.

Additionally, the field emission light source 100 further includes a plurality of side walls 116. The a plurality of side walls 116 are used to support the transparent substrate 108 and seal the field emission light source 100 to form an inner vacuum space.

It is noted that if desired, a grid electrode (not labeled) can be arranged between the cathode conductive layer 104 and the fluorescent layer 112, for extracting electrons from the electron emitters 106. For example, the grid electrode can be a metallic net formed by lithography. Generally, an electron-emitting effect of the electron emitters 106 can be increased accordingly.

In operation, when applying a large enough voltage to the cathode conductive layer 104 and the anode layer 110, electrons will emanate from the electron emitters 106. The electrons emitted from the electron emitters 106, travel to the anode layer 110 to strike the fluorescent layer 112 emission of light. The light emitted from the fluorescent layer 112, through the carbon nanotube film structure of the anode layer 110, is polarized by the carbon nanotube film structure and emitted from the field emission light source 100.

Compared to the conventional field emission light source and polarizer, the field emission light source in the present embodiment adopts the carbon nanotube film structure as an anode layer. The carbon nanotube film structure has a polarization effect to the light and polarized light is acquired directly.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission light source, comprising:

a substrate;

a cathode conductive layer located on the substrate;

a plurality of electron emitters located on the cathode conductive layer;

a transparent substrate spaced apart from the cathode conductive layer;

an anode layer located on the transparent substrate facing the electron emitters, the anode layer comprising a carbon nanotube film structure and the carbon nanotube film structure having carbon nanotubes arranged in a preferred orientation; and a fluorescent layer located on the anode layer facing the electron emitters.

2. The field emission light source as claimed in claim 1, wherein the carbon nanotube film structure comprises at least one layer of carbon nanotube film.

3. The field emission light source as claimed in claim 2, wherein the carbon nanotube film comprises a plurality of successive carbon nanotubes and the carbon nanotubes are arranged in a preferred orientation.

4. The field emission light source as claimed in claim 2, wherein a thickness of the carbon nanotube film is in an approximate range from 10 nanometers to 100 micrometers.

5. The field emission light source as claimed in claim 2, wherein adjacent carbon nanotube films are joined via van der Waals attractive force therebetween.

6. The field emission light source as claimed in claim 2, wherein the carbon nanotube film structure comprises more than 10 layers of the carbon nanotube film.

7. The field emission light source as claimed in claim 1, wherein a polarization degree of the carbon nanotube film structure is in an approximate range from 0.85 to 0.9.

8. The field emission light source as claimed in claim 1, further comprising a plurality of sidewalls and the sidewalls are located between the cathode conductive layer and the fluorescent layer.

9. The field emission light source as claimed in claim 1, further comprising a grid electrode and the grid electrode is located between the cathode conductive layer and the fluorescent layer.

10. The field emission light source as claimed in claim 1, further comprising a deposition layer positioned between the substrate and the cathode conductive layer.

11. The field emission light source as claimed in claim 1, wherein the plurality of electron emitters has micro-tips.

12. The field emission light source as claimed in claim 1, wherein a material of the plurality of electron emitters is selected from the group consisting of metals, non-metals, compositions, and one-dimensional nanomaterial.

13. The field emission light source as claimed in claim 12, wherein the one-dimensional nanomaterial comprises carbon nanotubes, silicon nanowires, or molybdenum nanowires.

14. The field emission light source as claimed in claim 1, wherein the carbon nanotube film structure comprises a plurality of the carbon nanotube films arranged side by side in parallel to each other.

* * * * *